US007395999B2

(12) United States Patent
Walpole

(10) Patent No.: US 7,395,999 B2
(45) Date of Patent: Jul. 8, 2008

(54) REINFORCED POLYMER PANEL AND METHOD FOR BUILDING CONSTRUCTION

(75) Inventor: Herbert Walpole, Houston, TX (US)

(73) Assignee: Polycrete Systems, Ltd, Houston, TX (US)

( * ) Notice: Subject to any disclaimer, the term of this patent is extended or adjusted under 35 U.S.C. 154(b) by 680 days.

(21) Appl. No.: 10/838,436

(22) Filed: May 4, 2004

(65) Prior Publication Data

US 2005/0247013 A1 Nov. 10, 2005

(51) Int. Cl.
*E04G 9/00* (2006.01)

(52) U.S. Cl. ..... 249/33; 249/18; 52/434; 52/564; 52/439; 52/503

(58) Field of Classification Search ..... 52/434, 52/564, 220.2, 405.1, 439, 503, 581; 249/18, 249/33

See application file for complete search history.

(56) References Cited

U.S. PATENT DOCUMENTS 2,114,388 A 4/1938 Killion
3,449,879 A 6/1969 Bloom
3,783,563 A 1/1974 Moore
4,306,395 A * 12/1981 Carpenter ..... 52/223.6
4,409,768 A 10/1983 Boden
4,512,126 A 4/1985 Walston
4,588,806 A * 5/1986 Aycock et al. ..... 528/215
4,774,794 A 10/1988 Grieb
4,835,928 A * 6/1989 Scott ..... 52/426
4,885,888 A * 12/1989 Young ..... 52/426
4,886,891 A * 12/1989 Torii et al. ..... 549/434
4,889,310 A * 12/1989 Boeshart ..... 249/41
4,924,641 A * 5/1990 Gibbar, Jr. ..... 52/204.1
4,936,540 A * 6/1990 Boeshart ..... 249/216
4,938,449 A * 7/1990 Boeshart ..... 249/216
4,970,838 A 11/1990 Phillips
4,984,406 A 1/1991 Friesen
5,335,472 A 8/1994 Phillips
5,479,751 A 1/1996 White
5,507,427 A 4/1996 Burgett
5,522,194 A 6/1996 Graulich
5,611,182 A * 3/1997 Spude ..... 52/426
5,658,483 A * 8/1997 Boeshart ..... 249/191
5,729,936 A 3/1998 Maxwell
5,842,276 A 12/1998 Asher et al.
5,881,519 A 3/1999 Newkirk (Continued)

*Primary Examiner*—Richard E. Chilcot, Jr.
*Assistant Examiner*—Chi Q. Nguyen
(74) *Attorney, Agent, or Firm*—James L. Jackson

(57) ABSTRACT

A method and apparatus for manufacturing reinforced wall panels and reinforced roof panels and using the pre-manufactured reinforced wall and roof panels in the construction of a building structure at a building site. The reinforced wall and roof panels are molded using a molding medium consisting of two part polyurethane which is mixed with Portland cement. Reinforcing members and exterior weather resistant materials are placed within a mold and the mold is filled with the molding medium by injection or by pouring. The filled mold is then placed within a press to ensure against expansion by internal pressure caused by curing of the molding medium, thus ensuring dimensional accuracy of the finished panel. After hardening of the molding medium, the mold is removed from the press, opened and the finished panel is removed from the mold and is stored until the molding medium has completely cured. The reinforcing members and weather resistant material constitute integral components of the building panel structure.

20 Claims, 15 Drawing Sheets

U.S. PATENT DOCUMENTS

| | | | | |
|---|---|---|---|---|
| 5,950,396 | A | 9/1999 | Fosdick | |
| 5,974,762 | A | 11/1999 | Rodgers | |
| 6,003,278 | A | 12/1999 | Weaver et al. | |
| 6,006,480 | A | 12/1999 | Rook | |
| 6,058,672 | A | 5/2000 | McClellan | |
| 6,099,768 | A | 8/2000 | Strickland et al. | |
| 6,105,326 | A | 8/2000 | Schmidt-Lutz | |
| 6,230,409 | B1 | 5/2001 | Billings et al. | |
| 6,298,622 | B1 * | 10/2001 | Cretti | 52/309.7 |
| 6,385,942 | B1 | 5/2002 | Grossman et al. | |
| 6,418,686 | B1 | 7/2002 | Record | |
| 6,438,923 | B2 | 8/2002 | Miller | |
| 6,557,256 | B2 | 5/2003 | Billings et al. | |
| 6,848,228 | B1 * | 2/2005 | Williams | 52/309.9 |
| 2003/0079483 | A1 | 5/2003 | Stephens et al. | |
| 2003/0167715 | A1 | 9/2003 | Messenger et al. | |

* cited by examiner

REINFORCED POLYMER PANEL AND METHOD FOR BUILDING CONSTRUCTION

BACKGROUND OF THE INVENTION

1. Field of the Invention

The present invention relates generally to wall and roof panels for use in the construction of buildings and to methods and processes for manufacturing wall and roof panels and methods for assembling such wall and roof panels to form building structures. More particularly, the present invention concerns reinforced wall and roof panels having structural members embedded in a polymer/Portland cement matrix for structural integrity and fire resistance and a method for their manufacture at a manufacturing site and a method for their assembly at a construction site to form a building structure.

2. Description of the Prior Art

A number of different types of prefabricated building panels have been developed and patented since the early 1930's as indicated by U.S. Pat. No. 2,114,388 of Killion, thus enabling wall structures to be installed in buildings and enabling wall and roof structures, which may be manufactured or fabricated off site, to be transported to a building site and assembled to form a building structure. For the most part, prefabricated or pre-manufactured building panels have been manufactured by assembling a variety of different mechanical components.

SUMMARY OF THE INVENTION

It is a primary feature of the present invention to provide a novel building panel for a building structure that includes a structural framework, preferably composed of steel and may also include panels of wire mesh for enhanced structural integrity and resistance to bending.

It is another feature of the present invention to provide a novel panel for building construction having structural components that are encapsulated in a polyurethane or other polymer composition, the polymer composition being composed of two-parts that are mixed and poured or injected into a mold containing the structural components.

It is also a feature of the present invention to provide a novel manufacturing process for building panels wherein a two-part polymer mixture, including a quantity of cement for flame spread resistance, is poured into a mold containing structural components and after hardening of the two-part polymer mixture, is removed from the mold in substantially complete condition for use in the construction of a building.

It is an additional feature of the present invention to provide a novel pre-manufactured building panel which is provided with an exterior or interior finish material or both as desired and which may be used, essentially as it emerges from the mold, for the construction of interior walls, exterior walls, roof panels and the like, without requiring any degree of interior or exterior finishing treatment.

It is another feature of the present invention to provide a novel roof panel for building construction wherein corrugated roofing metal, roofing metal of other desired configuration or non-metal roofing materials are placed within a mold along with other desired structural components of the panel and a two-part mixture of polyurethane and Portland cement are mixed and poured or injected into the mold so that the finished roofing panel from the mold has a weather resisting metal or non-metal skin as it emerges from the mold and is substantially ready for assembly with other building panels to form a building structure.

It is also a feature of the present invention to provide a novel manufacturing process for building panels wherein a press is provided to restrain panels of the mold so that during curing of the two-part polyurethane and Portland cement mixture the panels of the mold will be prevented from being forced outwardly by the tendency of the mixture to expand during curing, and ensuring that the finished building panel will have a precisely controlled configuration and dimension and further ensuring that the building panels can be readily fitted together to form a desired building structure.

It is an even further feature of the present invention to provide novel pre-fabricated panels that incorporate assembly hardware which is also embedded within the two-part polyurethane and Portland cement panel structure as the result of the panel molding process, thereby enabling the pre-manufactured reinforced building panels to be efficiently and accurately interconnected by relatively unskilled labor during building construction.

It is also a feature of the present invention to provide novel method for pre-manufacturing building panels, such as wall panels and roofing panels wherein structural components, optional wiring and plumbing components and a weather resistant panel are placed within a mold and the mold is placed within a press or restraining fixture and the mold is filled with a two-part polyurethane and Portland cement composition and the mold is restrained by the press or restraining fixture to ensure against deformation of the panel during hardening of the polyurethane and Portland cement composition.

Briefly, the pre-manufactured building panel system of the present invention uses an encapsulated wire mesh for durability. In addition, the pre-manufactured building panel is a pre-finished panel requiring no additional exterior finishes if desired. The pre-manufactured building panel system of the present invention utilizes an encapsulated metal framing member molded within the urethane body of the panel structure. An exterior or interior finishing substrate is located within the mold so as to become an integral component of the panel during the panel molding process. If the panel is intended as a roofing panel, the exterior finishing substrate may compose a metal sheet which may conveniently take the form of corrugated metal, sheet and rib metal or may take the form of a polymer roofing material or any other suitable type of roofing material.

To form the building panels of the present invention a polymer/Portland cement mixture is poured or injected into a mold in which is positioned reinforcing materials and installation hardware components and the exterior and interior substrate panels for the particular panel that is being molded. The polymer or urethane/Portland cement mixture is not of lightweight nature, as is typically the case with pre-manufactured building panels that are available at the present time, but rather with a 10# density urethane that is further mixed with a Portland cement for further characteristics of "flame spread" protection.

The mold is provided with one or more mold doors or closures that are opened to permit extraction of the finished panel. Immediately upon being filed with the polymer/Portland cement mixture or prior to filling of the mold, the mold is placed within a press or containment fixture which prevents dimensional expansion of the finished panel even under circumstances where the mixture expands during the preliminary curing or hardening process. After having become cured to the point that the polymer/Portland cement mixture has hardened, the dimensionally stable panel is removed from the mold and is transported to a site for completion of its curing process. Thus, the present invention represents a significant departure from conventional building panel systems which employ a light-weight urethane structure or employ a urethane encapsulating a core of lightweight polymer foam or other light-weight materials. The present invention also represents a significant departure from pre-manufactured building panels having external and internal finishing panels that are bonded or cemented to the typically cast or molded panel structures, for the reason that the external and internal finishing material are integral with the panel structure as it emerges from the mold. No additional panel finished surface treatment is required to make the panels ready for construction and no post construction panel treatment is required.

Steel reinforced polyurethane panels are manufactured, according to the principles of the present invention, from raw or resin state chemicals and Portland cement which together constitute a molding medium. Polyurethane chemicals are made up of two components, Part A and Part B. After a mold has been prepared with the necessary interior elements in place, along with any necessary release agents, primer and wax, the chemicals are first mixed separately with 25% Portland cement mix for improved hardness and reduced flammability. Then the Parts A and B of the molding medium are mixed together manually or with pneumatic head and injected or poured into the already prepared mold. Kraft paper or other suitable panel barrier material is then placed on the uncured, essentially liquid molding medium filling the mold. The mold lid is then placed over the mold and the mold is rolled into a press to secure the mold against deformation by any mold medium pressure that may occur during initial curing or rising of the molding medium. The mold lid confines the molding medium to the mold cavity and ensures maintenance of a desired cured molded body density within the poured panel. The molding medium begins to set during a period of from less than a minute to about two minutes after the parts A and B have been mixed. After approximately 20 minutes, the molding medium will have become hardened to the point that it can be removed from the mold. The mold is then removed from the press and opened and the finished, but not completely cured panel structure, is removed from the mold by lifting and handling equipment, such as a lift or crane mechanism. The mold is then prepared for molding of the next like panel structure. After approximately 48 hours from the time the partially cured panel or part has been removed from the mold, the panel is then primed and prepared for the final finish. For example, the panel may be provided with a surface covering of decorative and/or weather resistant material and the finished panel is then prepared for shipping.

Structural attachments for panel removal from the mold as well as for handling the finished panel are placed into the mold prior to pouring of the molding medium into the mold to form the reinforced panel structure. This allows for a safe and permanent attachment, not only for handling in the manufacturing area but also, and especially for, the panel installation process.

The structural requirements to accommodate both shear and wind load, are achieved by placing 2½ by 20 or 18 gauge metal studs directly into the interior of the panel and at predetermined locations within the mold. These studs are typically spaced at 16 inches on-center thus following pre-established framing criteria for building structures. The studs extend the entire length of the panel and provide the necessary screw attachment points for easy anchoring at the top and bottom tracks or channels.

Design support items such as electrical boxes, telephone junction boxes, electrical and plumbing conduits are preferably placed into the mold prior to pouring or injection of the molding medium. If desired, however, these building service components may be installed in assembly with the finished panel structure at the building site. This feature can be accomplished by cutting a vertical groove in a desired panel with a router for conduit or wire access and by attaching the electrical box directly to the framing member of the panel.

Prior to the introduction of a molding medium into the mold, a ½ by 8" anchor-bolt is installed into the top of a stud member for eventual attachment of a roof truss member to the wall panels of the building structure. The roof truss is secured to the metal stud via a J-bolt passing through the truss and secured on top by a washer and corresponding nut. It should be noted that the finished wall and roof panels are not sheet laminated, as is the current practice, but rather emerge from the mold with all components, including exterior surface preparation, weather resistant materials and the like being integral components of the panel structure.

The finished reinforced wall panels are secured to a foundation slab or subsurface by a corresponding lower track that is fixed in place by bolt and pneumatic attachments. The track structure has upstanding spaced flanges and is secured to the vertical stud members by screwing each flange of the metal track to the studs on each side as is typically required for metal stud application. A similar upper track is positioned at the top of the assembled wall panels and is joined by screws which extend through the track flanges and into the metal studs of the wall panel structure.

The wall panels have tongue and groove connections and each joint between panels is secured by a double-stick neoprene gasket which establishes positive sealing between adjacent panels at the tongue and groove joints. The joints are then caulked with an acceptable and corresponding calking compound on the inside and outside of each vertical panel joint.

Prior to installation of a wall panel, the bottom track is installed on top of a flashing that protect the interior finishes from any moisture infiltration if any moisture migrates through the joints. The bottom track or plate is secured through the flashing by bolt application and pneumatic pin attachment procedures for concrete and by bolt and screw attachment if the subfloor is a wood member or plywood substrate.

From the standpoint of specific finish and performance, the panels can be pre-finished per the end user selections from an array of designs and colors with an exterior grade paint or elastomeric coating. Additional textures, i.e., shell stone texture, simulated stone, brick or any other item that requires the surface to have "relief" more than just flat can be achieved in the mold. These textures are poured into the mold prior to any finish panel manufacturing. These "pre-finished applications" allow for very low installation durations and lend to quick occupancies of the building structures.

The inherent characteristics of the polyurethane lends to heating and cooling efficiencies determinable upon final completion and determination of the total cubic feet and layout of space. Also, finish elements such as windows and doors can be pre-installed in door and window panels as received from the panel manufacturer or factory and can be shipped for quick panel installation and erection.

The pre-manufactured, reinforced roof panels are made up with sheet metal roofing, such as corrugated sheet metal, on the top side and bottom side or reinforced sheet wiring on the bottom side. Both the metal roofing sheets and the wire mesh panels are placed into the mold prior to introduction of the molding medium and are thus integral components of the reinforced roof panels. The roof panels can be used with the corrugated metal finish on the outside and perform as shingles or with the corrugation facing downwardly and a selected finish shingle placed over the roof panel and secured thorough the panel to the sheet metal below with necessary screw attachment. The roof panels are a minimum of 2" thick and have male and female tongue and groove joint attachments similar to that of the vertical wall panels. Lap joints are secured to each other by conventional methods of screwing overlapping sheet joints with screws and washers.

Overall, this designed steel reinforced polyurethane panel system lends to a very quick and clean installation, erection and occupancy for any builder or end user. With the optimum performing characteristics of insulating, sound resistance, non moisture absorbing, low flame spread and non-wood characteristics, the steel reinforced polyurethane panel system provides optimum performance in all areas of installation and operation.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration, with parts broken away and shown in section, the figure illustrating a portion of a building structure employing wall and roof panels according to the teachings of the present invention;

FIG. 2 is a vertical sectional view showing a portion of a foundation of a building and showing a wall panel of the building being mounted on the foundation and being adapted for mounting to a roof and ceiling structure;

FIG. 3 is a partial vertical sectional view of a building structure showing mounting of a roof and roof joist structure to the pre-manufactured wall structure of the present invention and further showing anchoring of the roof and roof joist structure to the wall panels of the building;

FIG. 4 is an isometric illustration, with parts broken away and shown in section showing mounting of wall panels to a foundation and showing sealing between adjacent wall panels of the building;

FIG. 5 is a horizontal sectional illustration showing joined pre-manufactured wall panels according to the principles of the present invention:

FIG. 6 is an isometric illustration of a wall panel of the present invention being shown principally in broken line and showing the vertical typically metal structural framing members or studs of the panel, together with attachment hardware and an optional electrical box and wiring conduit;

FIG. 7 is an isometric illustration showing parts of the pre-manufactured wall panels of the present invention being joined at an exterior corner of a building structure;

FIG. 8 is an isometric illustration similar to FIG. 7 and showing exterior corner trim being mounted to the joined panels at the building corner;

FIG. 9 is a partial horizontal sectional view illustrating joining of wall panels by means of a corner panel connection strip fitting to form an exterior corner of a building structure;

FIG. 10 is a partial horizontal sectional view showing joining of pre-manufactured wall panels and corner strip fittings to define an interior building corner of other than 90° configuration, such as may be used in buildings of octagonal or other desired configuration;

FIG. 11 is a partial horizontal sectional view similar to FIG. 10 showing exterior wall panels and corner strip fittings for orientation of corner wall panels to define an exterior building corner of other than 90° configuration;

Figure 12:
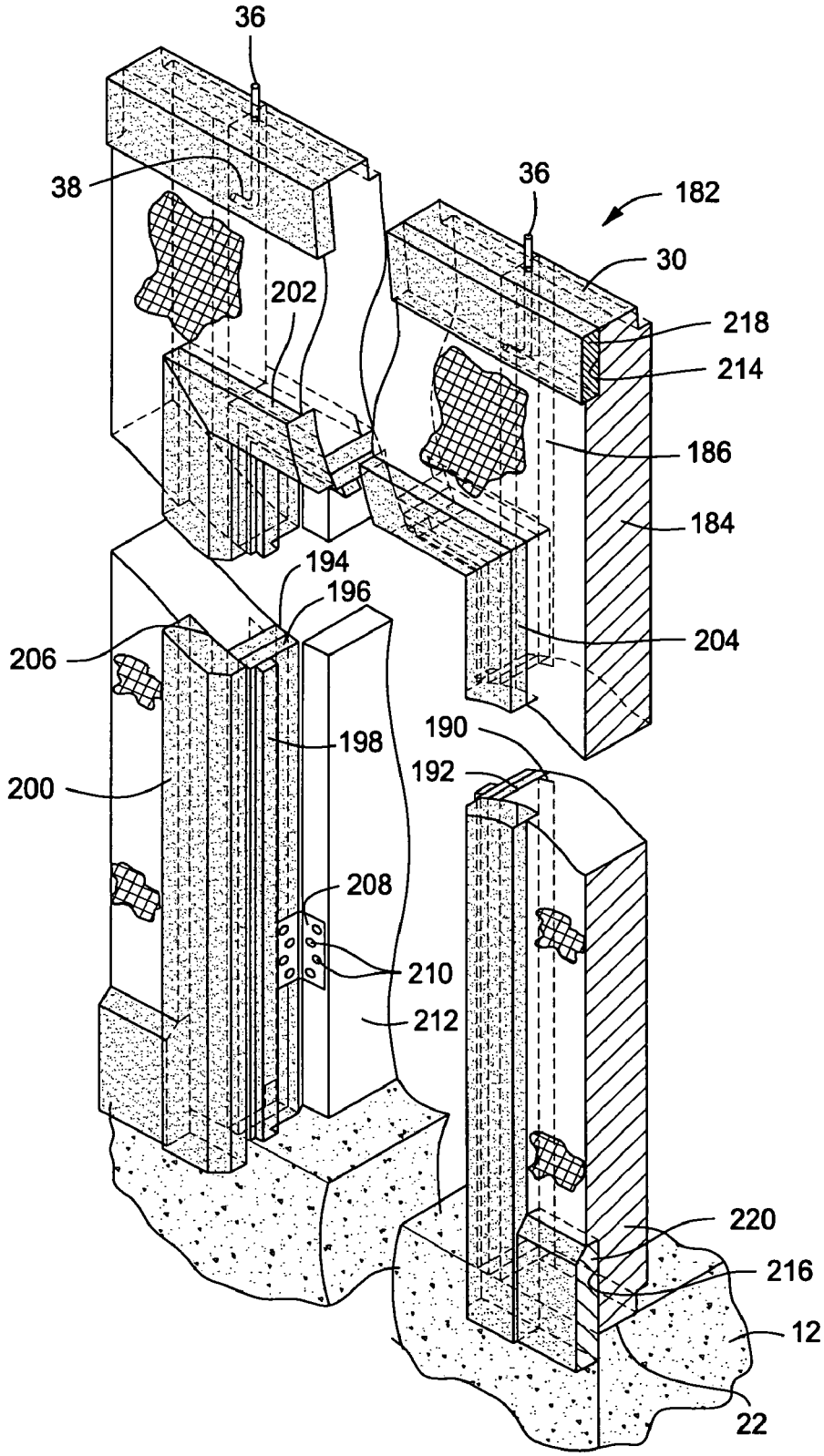
Figure 13:
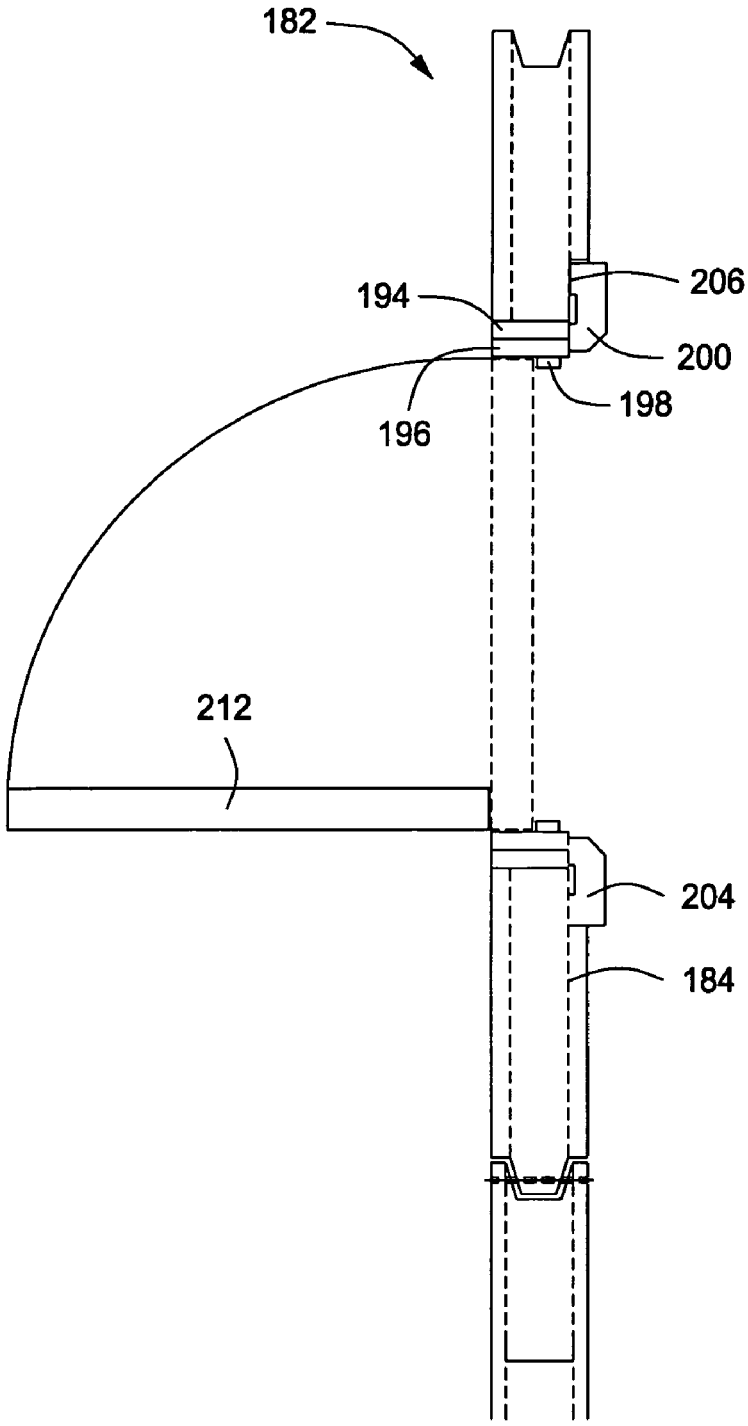
Figure 14:
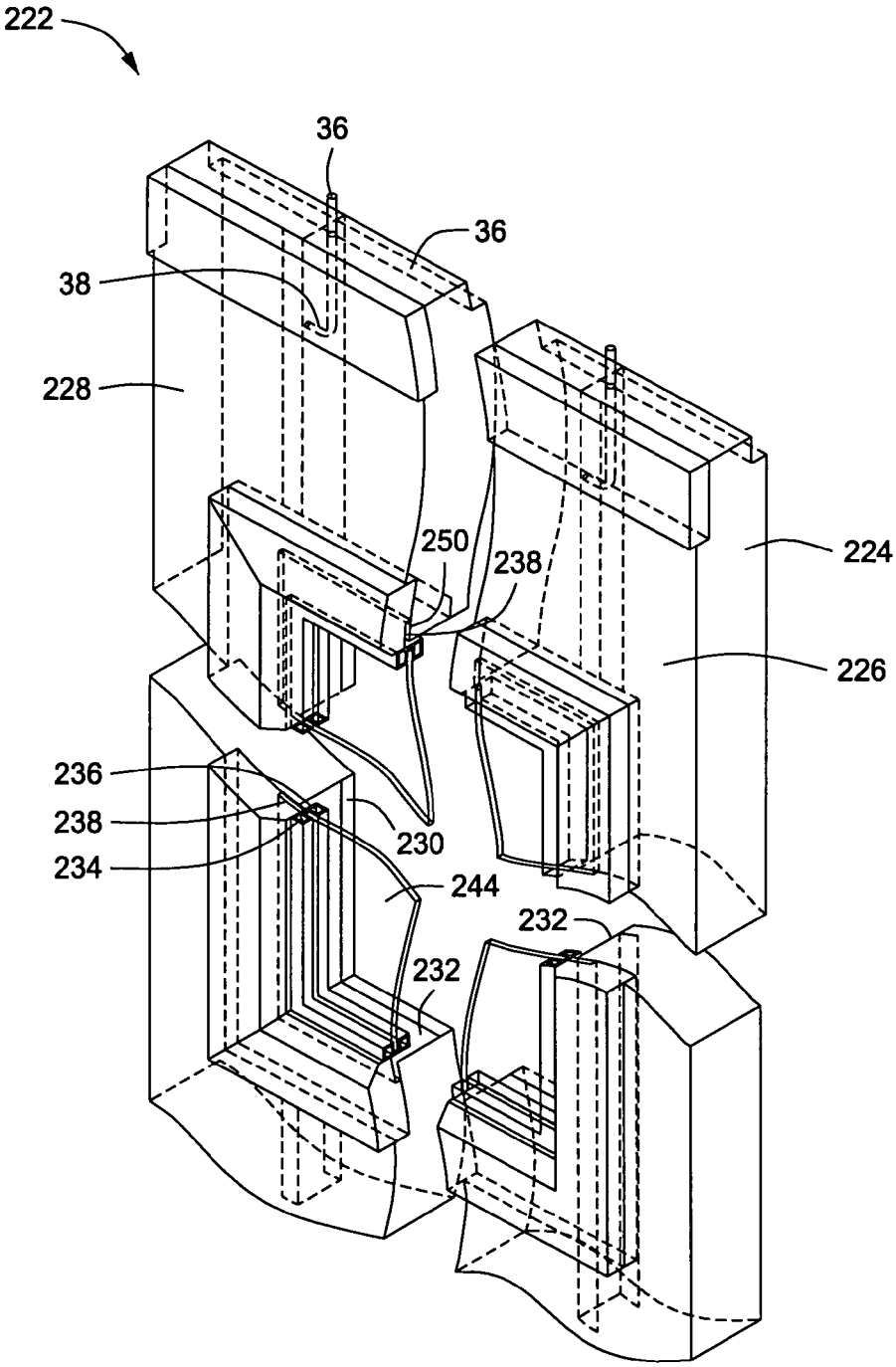
Figure 15:
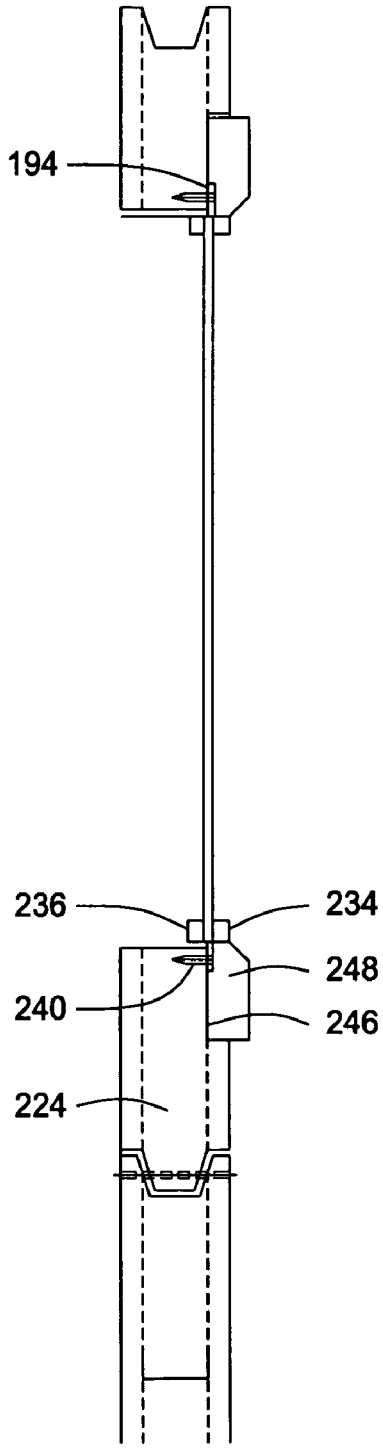
Figure 16:
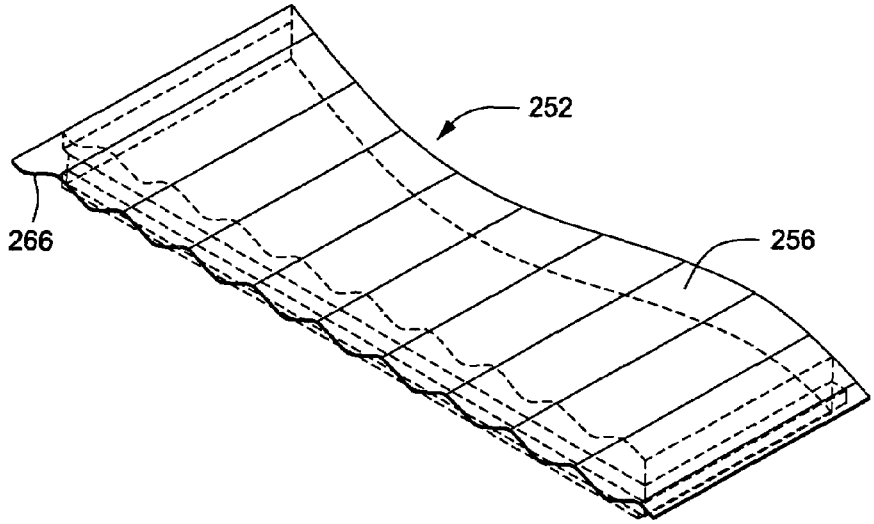
Figure 17:
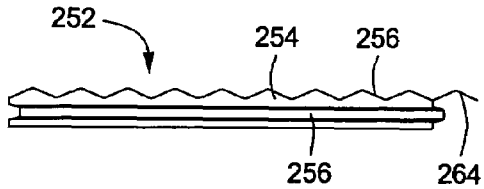
Figure 18:
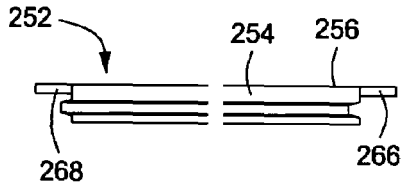
Figure 19:
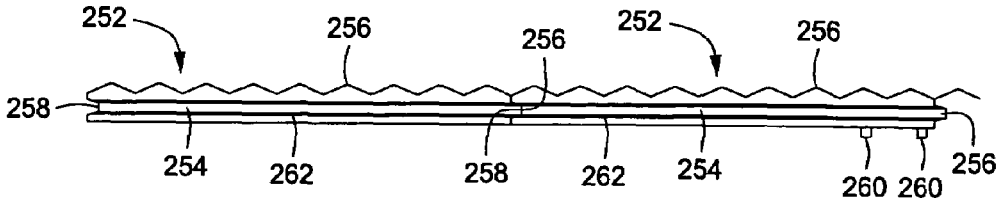
Figure 20:
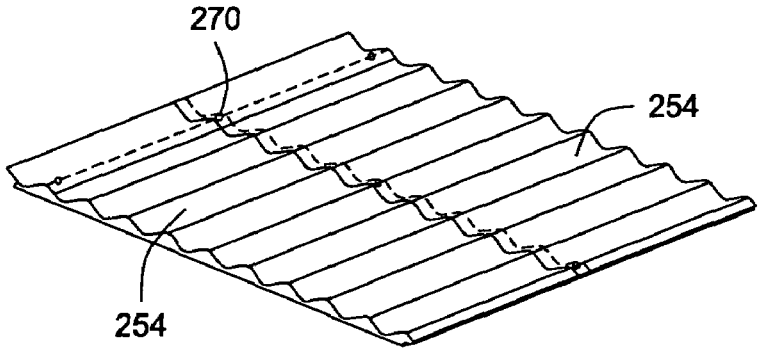
Figure 21:
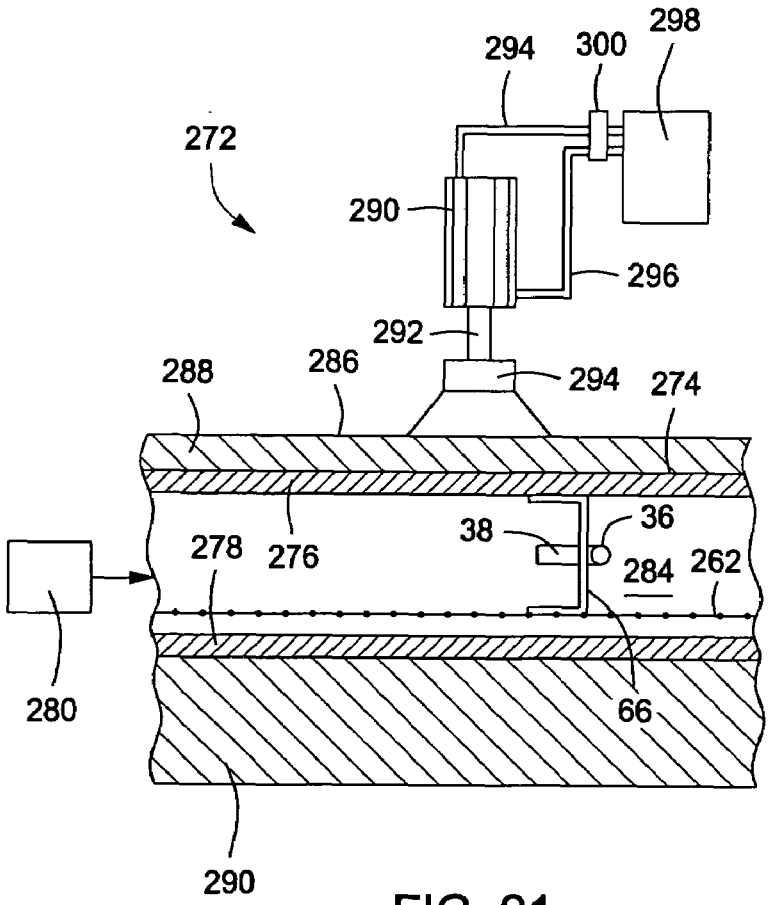

FIG. 12 is an isometric illustration showing a door opening panel that is constructed according to the principles of the present invention;

FIG. 13 is a horizontal sectional illustration showing the door opening panel of FIG. 12, with a door shown in assembly therewith and being shown in its open position;

FIG. 14 is an isometric illustration showing a window opening panel that is constructed according to the principles of the present invention and further showing a window and window trim assembly being mounted therein;

FIG. 15 is a horizontal sectional illustration showing the window opening panel of FIG. 14, with a window and window trim assembly shown in assembly therewith;

FIG. 16 is an isometric illustration showing an end portion of a corrugated roof panel, with portions of the roof panel being shown in broken line;

FIG. 17 is an end view illustration showing the corrugated roof panel of FIG. 16;

FIG. 18 is a side view illustration showing the corrugated roof panel of FIG. 16;

FIG. 19 is an end view illustration showing joined corrugated roof panels to form a roof structure of a building;

FIG. 20 is an isometric illustration showing the joined corrugated roof panels of FIG. 19 and illustrating overlapping of the corrugated metal sheets of the roof panels; and FIG. 21 is a partial sectional illustration showing a mold within which a building panel is molded and showing a press or containment fixture within which the mold is located to ensure the maintenance of accurate building panel dimension by resisting expansion or other deformation of the mold by any internal pressure that might be caused by expansion of the polyurethane and Portland cement mixture from which the building panels are molded.

DETAILED DESCRIPTION OF PREFERRED EMBODIMENT

Figure 1:
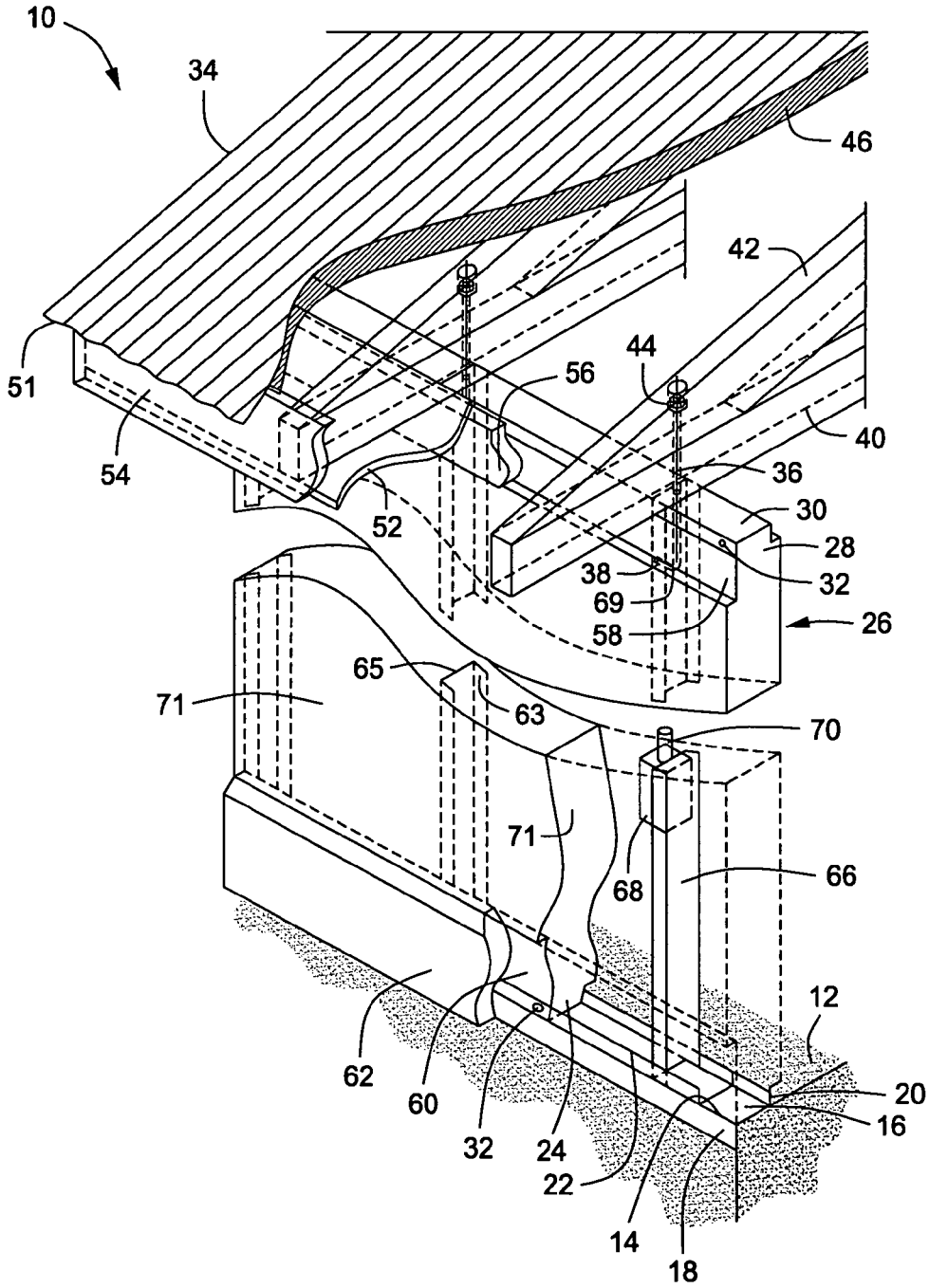

Referring now to the drawings and first to the isometric illustration of FIG. 1, a portion of a building structure composed of pre-manufactured reinforced wall and roof panels according to the principles of the present invention is shown generally at 10. According to the preferred embodiment of the present invention, a building structure will comprise a foundation 12 such as may take the form of a concrete slab foundation as shown or any other suitable type of foundation. A wall mounting foundation strip 14 having a horizontal web 16, a depending external flange 18 and an interior upstanding flange 20 is fixed to outer edge portions of the foundation 12 such as by means of power driven mounting studs or concrete nails. To the wall mounting foundation strip 14 is fixed a wall panel bottom mounting channel 22 having a central horizontally oriented web and spaced upstanding channel flanges defining a groove or channel within which is received the lower connection portion 24 of a pre-manufactured reinforced wall panel shown generally at 26.

Each of the pre-manufactured reinforced wall panels defines an upper connection section 28 on which is received a wall alignment cap 30 in the form of a generally U-shaped channel member which may, if desired, be substantially identical to the panel bottom mounting channel 22. The alignment cap has a C-shaped cross-sectional configuration and defines a central web and spaced downwardly projecting channel flanges defining a channel within which the upper ends of the pre-manufactured wall panels are received. Screws, bolts or any other suitable fasteners 32 are employed to secure the channels 22 and 30 to respective bottom and top connection sections 24 and 28 of the pre-manufactured reinforced panel structures. The specific structure of the wall panels of the present invention are described in detail hereinbelow in connection with the method or process by which the wall panels are pre-manufactured by a molding process of the present invention that is described in detail.

For connection of a roof structure shown generally at 34 to the building 10, the pre-manufactured reinforced wall panels 26 will have roof mounting hardware integral therewith and projecting therefrom. The pre-manufactured reinforced wall panels 26 are also provided with lifting and handling hardware, enabling the hardened panels to be removed from a mold and moved to a curing site for complete curing of the molding medium and then handled by equipment during transportation to a construction site and further handled during installation on a foundation at the construction site. As shown particularly in FIG. 1-3, the roof mounting hardware may conveniently take the form of roof anchor members 36, such as L-shaped anchor bolts with laterally projecting anchor sections 38 that have anchoring engagement with internal metal studs or other internal structural members of the pre-manufactured reinforced panel structures 26 and also being embedded within the polyurethane and Portland cement molding medium of the wall panel structure. The anchor members 36 extend through vertically oriented passages of ceiling joists 40 and roof rafters 42, with nut and washer assemblies 44 being received by threaded upper ends of the mounting bolts 36 and being tightened to secure the roof structure to the wall panels of the building structure.

A plurality of pre-manufactured roof panels, shown generally at 46, are supported by and fixed to the roof rafters 42 and may have interior surface treatment 48, such as an integral decorative or moisture proofing panel that is an integral component of the roof panel as pre-manufactured, thus ensuring that post-installation surface treatment of the roof panel is not required under circumstances where the roof panels are intended to be exposed internally of the building structure. The pre-manufactured roof panels are provided with an integral weather resistant exterior surface material 50 which, in the preferred embodiment, is preferably a metal panel, such as corrugated galvanized sheet steel or galvanized standing seam galvanized metal roofing material. For purposes of the present invention, and for simplicity of understanding of the present invention, the various figures of the drawings illustrate the weather resistant exterior surface material 50 as being corrugated steel roofing panels. The specific structure of the roof panels of the present invention are described in detail herein below in connection with the method or process by which the roof panels are pre-manufactured by a molding process that comprises a part of the present invention.

Figure 3:
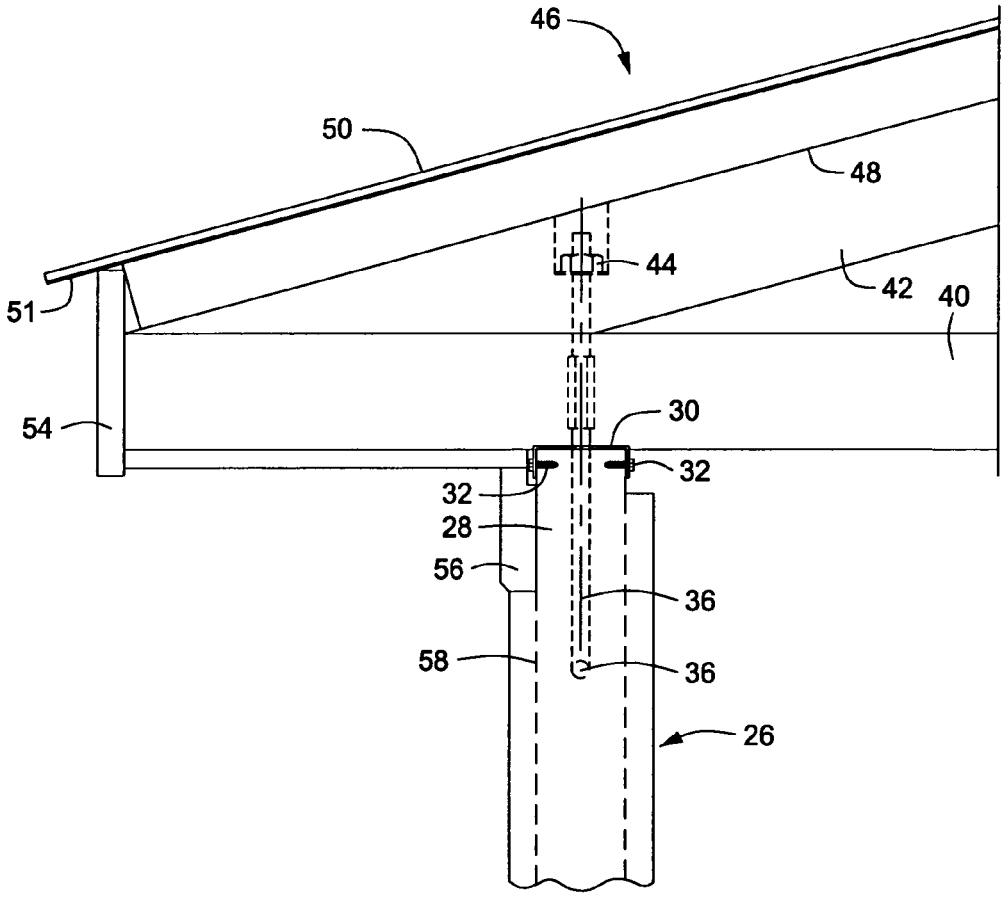

The eves of the building structure 10 are finished in the manner shown in FIGS. 1 and 3, where a soffit panel 52 is secured to the external bottom edges of the ceiling joists 40 and a fascia panel 54 is fixed to the ends of the exposed ceiling joists and is also fixed to edge portions of the roof panels 46 beneath the overhanging ends 51 of the weather resistant exterior surface material 50. Exterior wall panel trim 56 is fixed to the upper connecting portions of the wall panels 26 within an upper trim recess 58 of the wall panels by means of panel adhesive and screws or by any other suitable type of fasteners. The soffit panels 52 may define vent openings if desired and may be fitted with soffit vent members.

The wall panel structure 26 also defines a bottom trim recess 60 which is provided to receive a bottom trim panel 62 which is fixed to the wall panel 26 by panel adhesive and means of fasteners of any suitable character. The bottom trim panel defines an outwardly spaced depending section 64 that is spaced from and extends downwardly beyond the wall panel bottom mounting channel 22 and extends near the bottom edge of the wall mounting foundation strip 14. The bottom trim panel ensures that water descending along the exterior surface of the wall panel structure does not enter the panel/foundation joint.

Figure 6:
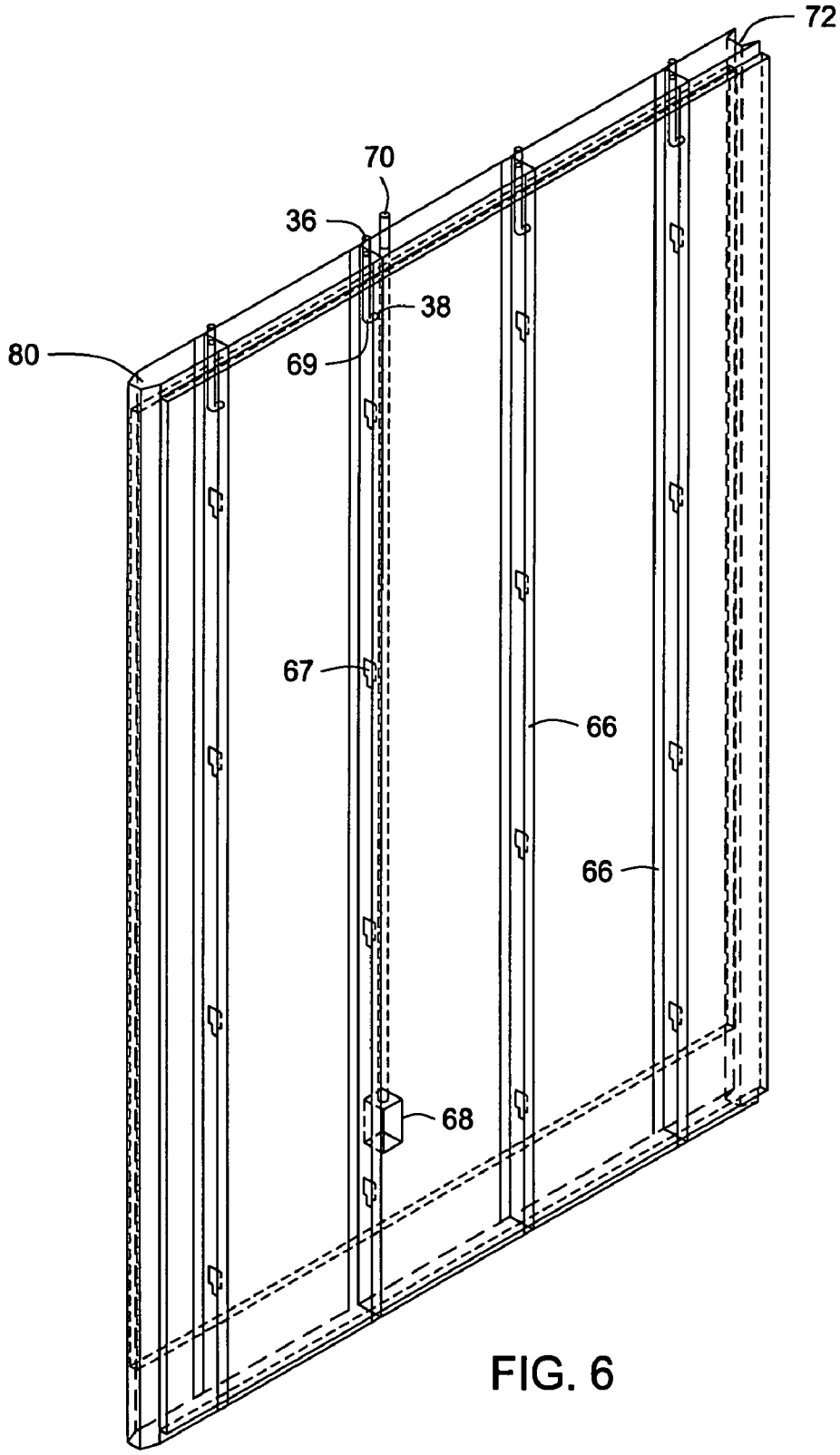

The pre-manufactured wall panels 26 are reinforced by means of internal structural members such as metal or non-metal wall panel studs 66 that are molded within the wall panels during the panel molding process. The wall panel studs 66 are of generally rectangular configuration and have a U-shaped cross-sectional configuration being defined by generally parallel stud flanges 63 which are integral with and extend from opposite sides of a central stud web 65. The central stud web defines a plurality of stud web openings 67 that permit the polyurethane and Portland cement molding medium to extend through them and establish mechanically interlocking or integral relationship with the wall studs, further ensuring the structural integrity of the pre-manufactured reinforced wall panel structure. As shown best in FIG. 6, each of the wall panel studs 66 also defines an anchor opening 69 that receives the laterally offset lower end 38 of the roof mounting anchors and thereby establishes a mechanical interconnection of the roof mounting anchors with the wall stud members 66. Additionally, optional service systems for electrical and plumbing systems may be incorporated into the wall panel structures. As shown in FIG. 1 electrical boxes 68 may be fixed to the metal or non-metal wall panel studs and electrical wiring conduits 70 may be embedded within the wall panels to provide for ease of electrical service installation after the building structure has been erected. Piping for plumbing services may be embedded within the wall panels in similar fashion as desired. Sections of pressure containing water piping, for example, may be made up when wall panels are assembled, with O-rings located in panel pipe joints to establish and maintain pipe joint seals.

Figure 2:
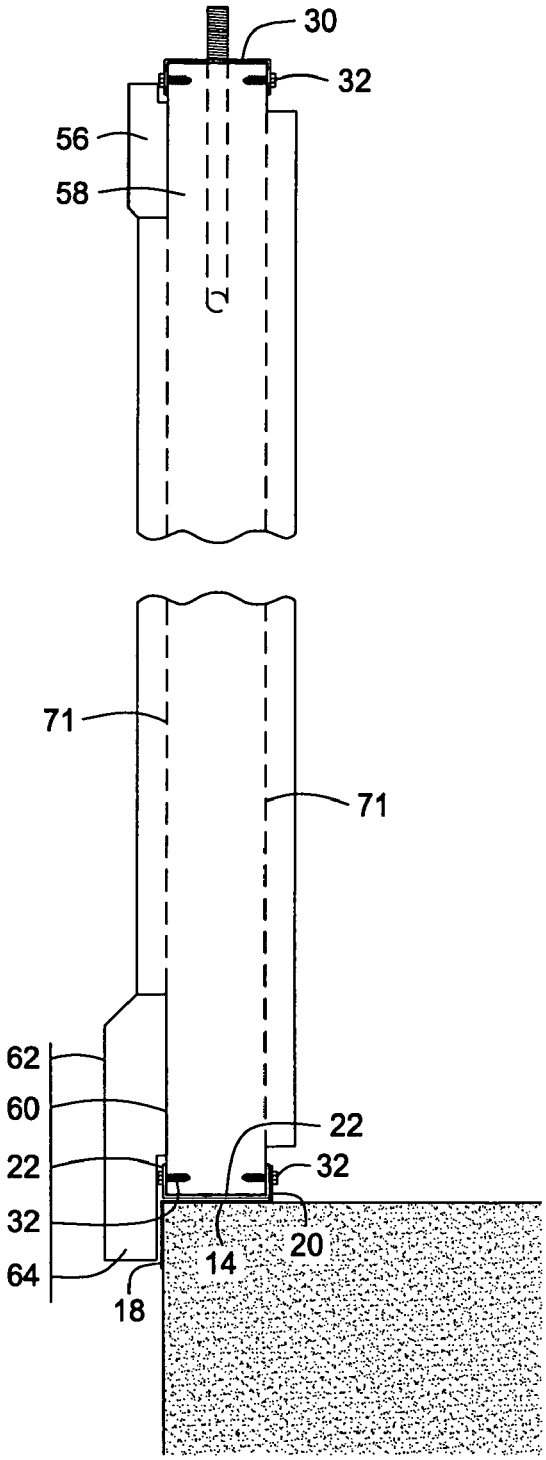
Figure 4:
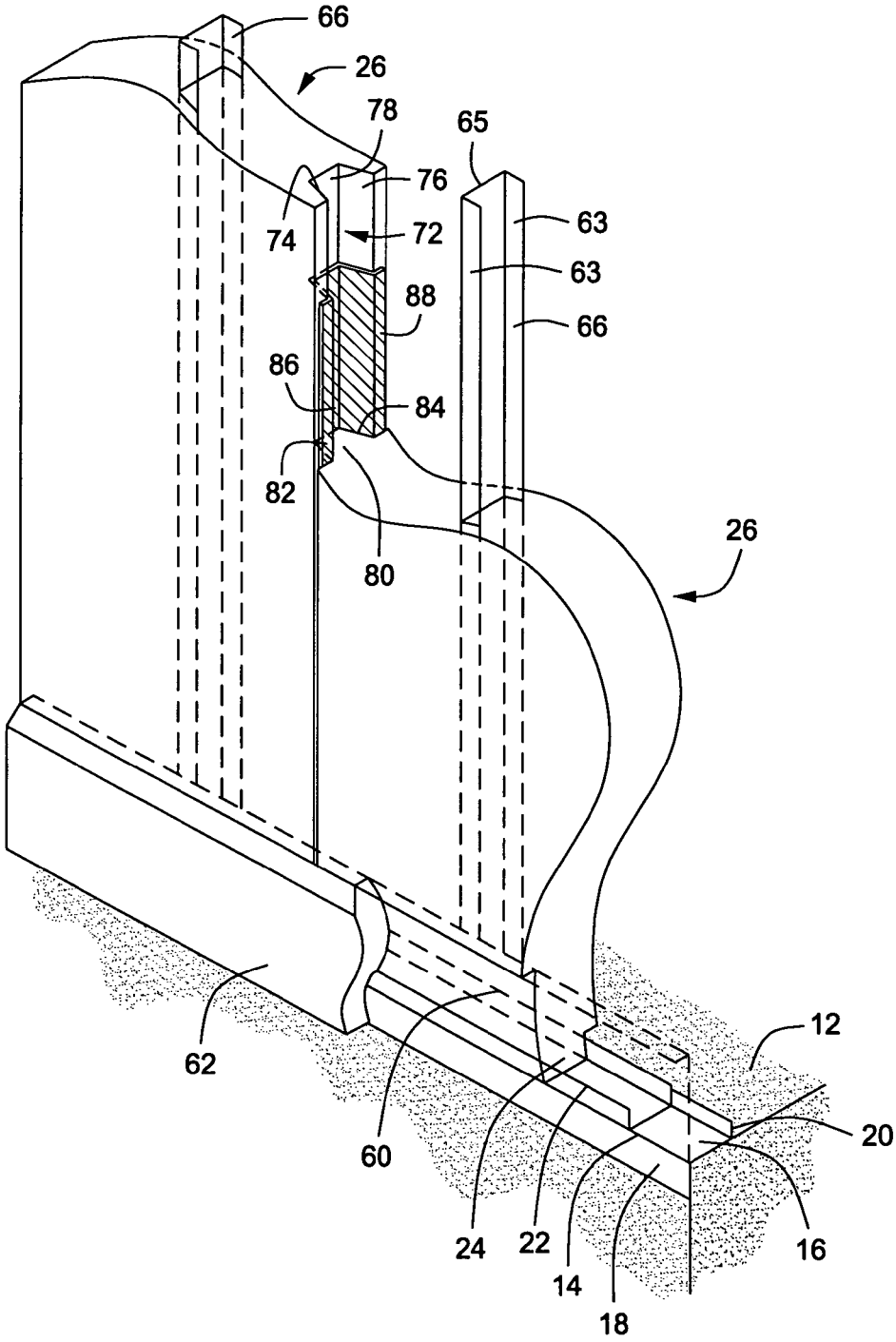
Figure 5:
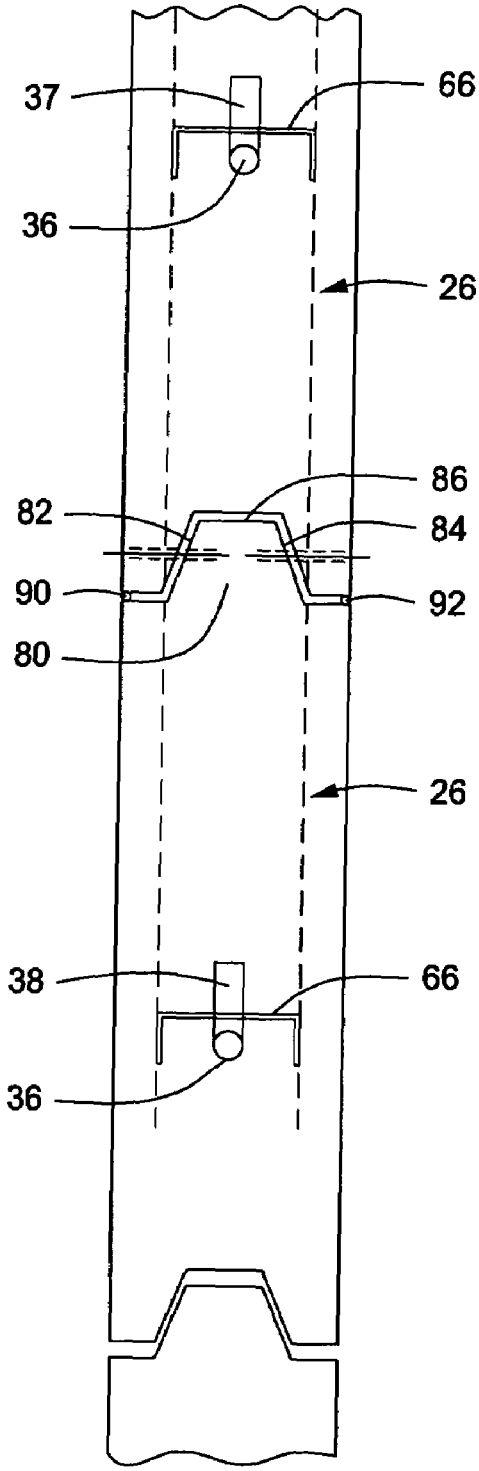

The pre-manufactured reinforced wall panels are also reinforced by one or more panels of structural mesh material 71 which is completely embedded within the polyurethane and Portland cement body structure of the wall panels and is located in spaced and substantially parallel relation with the outer planar surface of the wall panels. Preferably, the structural mesh material comprises wire mesh, preferably steel wire mesh, but may be composed of expanded metal panels or porous panels of non metal material having desired structural integrity for desirably enhancing the structural integrity of the reinforced wall panels. If desired, as shown in FIG. 2, parallel layers of structural mesh material 71 may be embedded within the polyurethane and Portland cement body structure of the wall panels and may be located in substantially parallel relation with respective internal and external planar wall surfaces of the wall panels. The reinforced roof panels 46 are also structurally enhanced by one or more panels of structural mesh material which is embedded therein during the molding process for the roof panels Referring now to the isometric illustration FIG. 4, which shows part of a wall section having joined wall panels, the wall panels are shown to define an internal wall joint or connection groove on one side, as indicated generally at 72 which is defined by tapered side walls 74 and 76 that extend outwardly from a central groove wall 78. The adjacent panel that is intended for connection is provided with an external wall connection geometry 80 having corresponding configuration being defined by tapered wall edge surfaces 82 and 84 that are joined by a planar edge surface 86. It is appropriate to establish a seal at wall panel joints or connections via the use of a joint seal member 88 that is generally in the form of the geometry of the internal and external wall joints. Preferably this joint seal member takes the form of neoprene or other suitable gasket material that is formed of flat gasket material or molded to the desired configuration of the wall panel joint geometry and then placed under compression when the pre-manufactured wall panels are placed in assembly. Alternatively, the wall panel joint seal member may conveniently take the form of external and internal joint seal strips 90 and 92 that establish external and internal seals at wall panel joints in the manner shown in FIG. 5. In comparison, FIG. 5 also shows a joint seal gasket 88 establishing a seal between wall panels at a panel joint.

Figure 8:
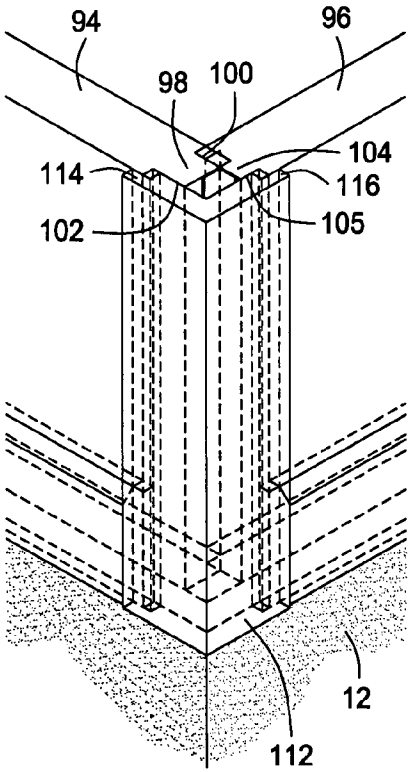
Figure 7:
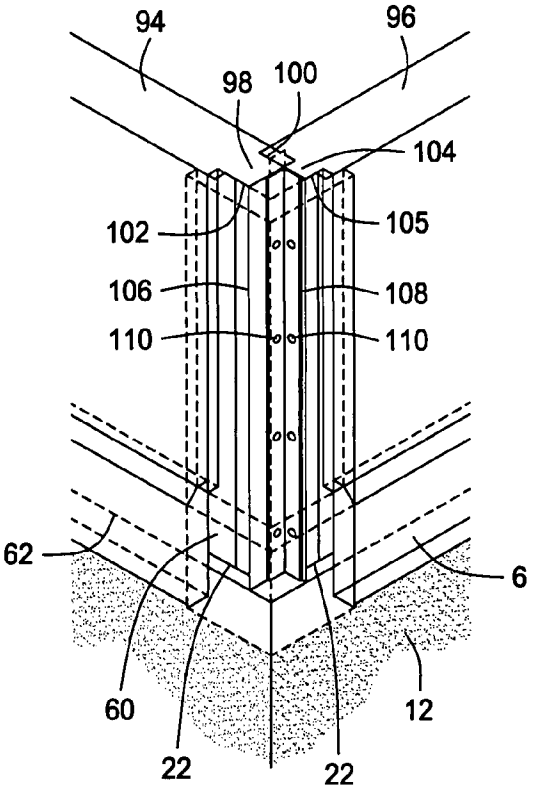
Figure 9:
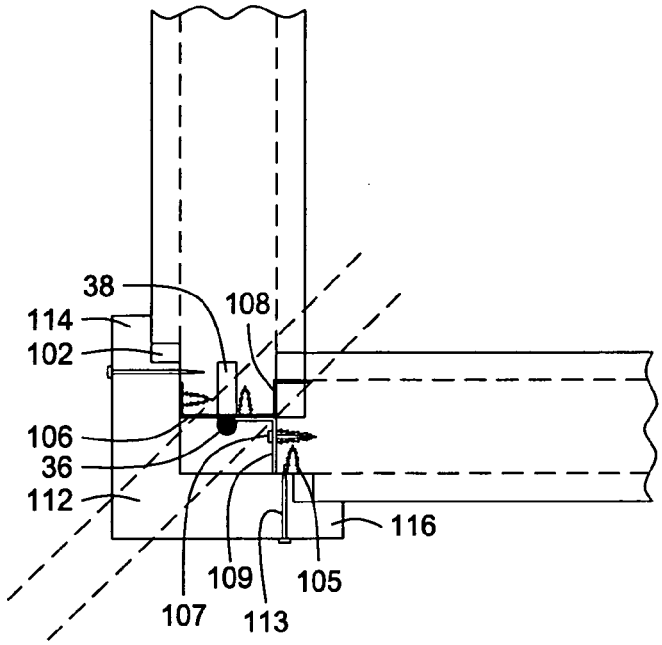

Referring now to FIGS. 7, 8 and 9, corner wall panels 94 and 96 having pre-manufactured corner panel configuration according to the principles of the present invention will be employed to form the corners of a building structure. The corner panels 94 are pre-manufactured with corner connection geometry having a connection projection 98 that is defined by an interior panel recess 100 and an exterior corner trim recess 102. The opposite corner wall panel 96 is provided with a corner connection geometry 104 that is received by the interior panel recess 100 as shown in FIG. 8. Corner structural members 106 and 108, typically composed of bent steel sheet material are secured to the respective connection ends 98 and 104 of the corner wall panels by means of fasteners 110, such as screws, bolts or fasteners of any suitable type. To further strengthen the corners of the building structure, an angle member 109, best seen in the partial horizontal sectional view of FIG. 9, is connected at the angular intersection of the corner structural members 104 and 106 by screws, bolts or other fastener members 107 that extend through both the connection flanges of the angle member and the respective corner structural members and into the respective corner wall panels. The bottom trim panels 62 are received within the bottom trim recesses 60 that are defined by each of the wall panels including the corner wall panels. Exterior corner trim members 112 have interior portions that are received within the exterior corner trim recesses 102 and 105 of connected corner wall panels and also have corner projection flanges 114 and 116 that overlap portions of each of the corner wall panels as shown in FIGS. 8 and 9 to provide enhanced weather proofing at the respective exterior corners of the building structure. The exterior corner trim members are applied with exterior panel adhesive or caulk and secured to the corner wall panels by nails or screws to hold the exterior corner trim in place until such time as the adhesive becomes cured.

To provide for efficient roof structure support at the exterior corners of the building structure, as shown in FIG. 9, roof anchor members, such as anchor bolts 36 are positioned with the laterally offset lower end sections 38 thereof extending through the corner structural member 106 and being embedded within the material from which the corner wall panels are molded. The upper threaded ends of the roof anchor members 36 extend beyond the upper ends of the roof panels and are received by ceiling joists and roof rafters of the building structure in the manner discussed above in connection with FIGS. 1 and 3.

Figure 10:
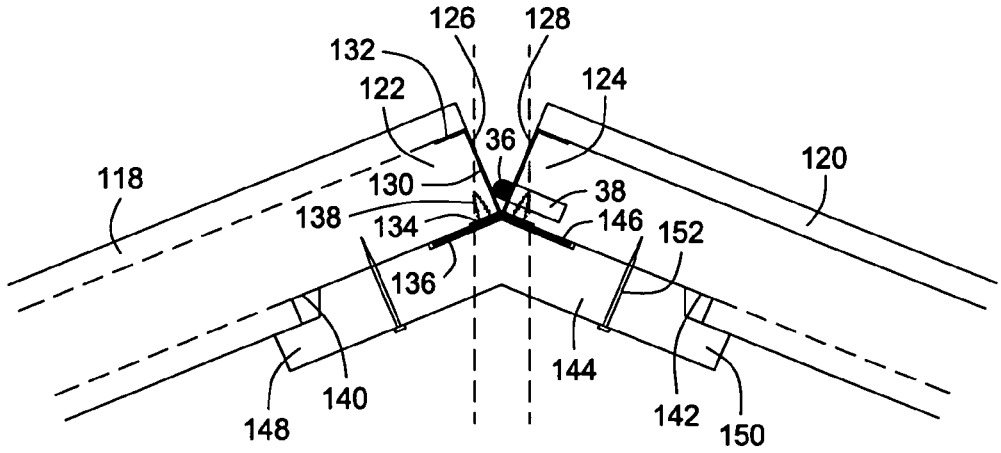
Figure 11:
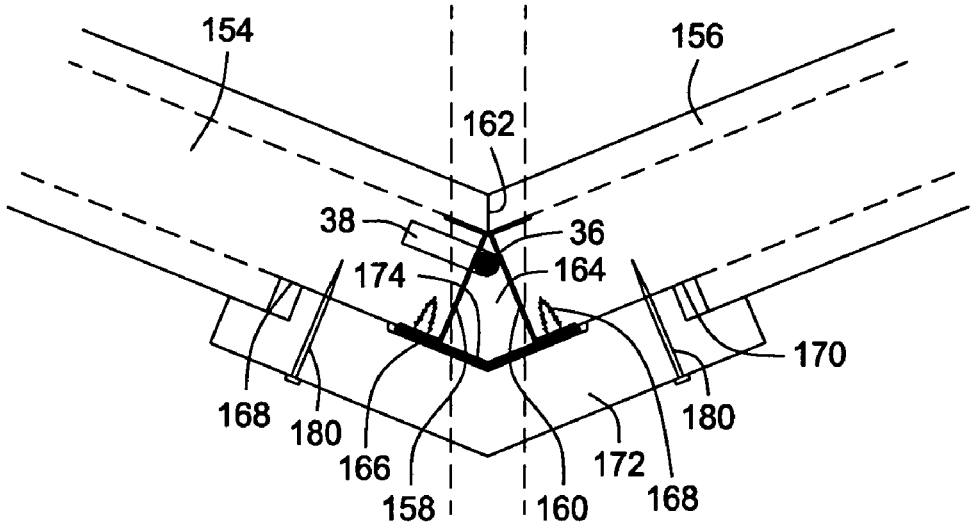

Though corner wall panels may be oriented at 90° as shown in FIGS. 7-9, it is evident from FIGS. 10 and 11 that corner wall panel orientation other than 90° is easily accomplished according to the principles of the present invention. FIG. 10 shows corner wall panels 118 and 120 that may be similar or substantially identical to the wall panels 94 and 96 of FIGS. 7 and 8. Corner ends 122 and 124 of the corner wall panels 118 and 120 have integral therewith corner structural members 126 and 128 respectively that are each preferably composed of sheet material such as steel that are bent to a U-shaped configuration, defining a central web 130 from which extends a pair of structural flanges 132 and 134. The structural flanges are preferably oriented at angles of 90° with respect to the flat central web 130 and are embedded within the corner panel structure so as to be an integral component of the corner panel. The central web 130 of each of the corner structural members defines an end of the respective corner panel. One of the corner wall panels is provided with an anchor member 36, as shown in FIG. 10, which has an offset connecting end 38 that extends through an anchor opening of the central web 130 of the panel structural member 128 and is embedded within the polyurethane and Portland cement composite material that forms the body structure of the corner wall panel 120.

The corner wall panels 118 and 120 are oriented at an angle less than 90° as is evident from FIG. 10. This angular relationship is established principally by orientation of the wall mounting foundation strip on the foundation structure of the building. This angular relationship is established in part by an angular panel joint strip member 136 having opposed angulated flanges that are secured to the respective corner wall panels by screws or other suitable fasteners 138 that extend through both the angular panel joint strip member 136 and a structural flange of the corner structural member and extend into the corner wall panel material. Each of the corner wall panels define exterior trim recesses 140 and 142 that receive opposite side portions of an exterior corner trim member 144. The exterior corner trim member 144 also defines an interior angulated recess 146 within which the angular panel joint strip member 136 is located. The trim member 144 also defines corner projection flanges 148 and 150 that are disposed in overlapping relation with exterior side portions of the respective corner wall panels 118 and 120. In the same manner as the corner trim member of FIG. 9, a quantity of adhesive caulk is applied within the exterior trim recesses and the corner trim member is secured in place by a plurality of nails 152 that maintain the position of the exterior trim member until the adhesive caulk material has become cured. The adhesive caulk material thus serves to retain the exterior corner trim member in assembly with the corner panels and establishes a weather resistant seal at the corner joints of the building structure.

The exterior corners of the building structure, as shown in FIG. 11, are defined by other wall corner panels 154 and 156 that have corner structural members 158 and 160 that may have the same configuration and purpose as the corner structural members 126 and 128 of FIG. 10. Additionally, the corner wall panel 154 is provided with an anchor member 36 in the form of an anchor bolt having an offset, laterally extending lower end portion that extends through an opening of the corner structural member 158 and is embedded within the polyurethane and Portland cement body structure of the wall panel. Interior edge portions of each of the corner wall panels are beveled to accommodate angular orientation of the corner wall panels 154 and 156 and to provide a tight interior corner joint 162.

To provide an external closure for a panel joint space 164 that is defined by the corner wall panels 154 and 156 an angled closure strip 166 is positioned with opposed flanges overlapping the ends of the corner wall panels 154 and 156 as shown. The opposed flanges are disposed and the same relative angles as the angular relations of the wall panels. Fasteners 168, such as screws extend through the angulated flanges of the corner wall panels and affix the angled closure strip to respective corner wall panels. One of the corner wall panels will typically be provided with an anchor member 36, such as an anchor bolt which has a lower laterally extending anchor end 38 embedded within the polyurethane and Portland cement body thereof during the molding process for the corner wall panel.

Each of the corner wall panels 154 and 156 define exterior trim recesses 168 and 170 that receive opposite side portions of an exterior corner trim member 172. The exterior corner trim member 172 also defines an interior angulated recess 174 within which the angular panel joint strip member 166 is located. The exterior corner trim member 172 also defines corner projection flanges 176 and 178 that are disposed in overlapping relation with exterior side portions of the respective corner wall panels 154 and 156. In the same manner as the corner trim members of FIGS. 9 and 10, a quantity of adhesive caulk is applied within the exterior trim recesses and the corner trim member is secured in place by a plurality of nails 180 that maintain the position of the exterior trim member until the adhesive caulk material has become cured. The adhesive caulk material thus serves to retain the exterior corner trim member in assembly with the corner panels and establishes a weather resistant seal at the corner joints of the building structure.

The isometric illustration of FIG. 12 shows a door panel generally at 182 which is formed primarily of polyurethane and Portland cement and by a molding process in the same manner and according to the same manufacturing process as discussed above in connection with the wall panels and corner wall panels. The door panel defines a reinforced panel body 184 having internal structural members 186 and wire or expanded metal mesh 188 material that provides a part of the reinforcement for the panel body. The panel body is also provided with anchor members 36 with offset anchoring portions 38 that establish mechanical interconnection with the internal structural members or studs 186. The panel body 184 is also provided with an upper metal wall alignment cap or roof support channel 30 of generally U-shaped configuration and a bottom wall mounting channel 22 which are fitted to the panel body prior to panel installation and thus are components of the panel body structure. The door panel 182 defines a rectangular door opening 190 which is defined in part by a U-shaped metal structural member 192 that has a generally U-shaped cross section and is also an integral structural component of the door panel body 184, being located within a mold when the door panel is molded. In the alternative, the structural member 192 may be defined by a plurality of substantially straight structural door panel strips that are positioned within the mold when the door panel is molded and thus defines a portion the door opening 190.

Referring now to FIGS. 12 and 13, within the door opening 190 is mounted door frame members 194 and 196 and door stop molding strips 198, all of which are not integrally manufactured into the panel, which may be composed of wood, composite wood, polymer or any other suitable strip material and may be secured in place by fasteners such as nails, screws or the like. External door trim members 200, 202 and 204 are positioned within door trim recesses 206. Door hinges 208 are received by hinge recesses in the door frame member 196 and are secured in place by screws or other fasteners 210 for hinged support of a door 212 which is shown at its open position in FIG. 12. The door 212 may be composed of wood, metal, polymer or any other suitable material or materials. The door panel 182 also defines upper and lower exterior trim recesses 214 and 216 within which are received upper and lower external trim members 218 and 220. The upper and lower external trim members 218 and 220 may be the same trim members as identified above by reference numerals 56 and 62 in connection with the discussion concerning FIGS. 1, 2, 7 and 8.

Referring now to FIGS. 14 and 15, the various pre-manufactured reinforced wall panels of the present invention will also include a reinforced window panel structure shown generally at 222 which has a reinforced window panel wall 224 which is molded from polyurethane and Portland cement mixture in the same manner as discussed above. The reinforced window panel wall 224 is composed of a mixture of polyurethane and Portland cement which is poured or injected into a mold containing various reinforcing materials such as metal wall studs 226 and wire mesh or expanded metal reinforcing material 228. Anchor members 36 are also molded within the polyurethane and Portland cement molding composition and thus form integral components of the reinforced window panel wall 224. The reinforced window panel wall 224 defines a window opening 230 of rectangular configuration, with a metal structural frame member 232 of U-shaped cross-section being molded or attached within the window wall panel and thus being an integral component of the reinforced window wall panel structure.

Window frame members 234 and 236 of rectangular cross-sectional configuration have mounting flanges through which fasteners 240 such as nails or screws extend for securing the window frame members to the reinforced window panel wall 224 as best seen in FIG. 15. The fasteners will also penetrate a flange portion of the window frame members as is evident from FIG. 15 The window frame members 234 and 236 are disposed in spaced relation, defining a window support slot or receptacle 242 of rectangular configuration within which the edges of a window panel 244 are located. The window panels may be composed of glass or may be composed of Lexan™ or any of a number of transparent window panel materials. One or both of the window frame members 234 and 236 may include a seal recess containing a sealing member establishing a weather tight seal between window frame members 234 and 236 and the window panel 244. Alternatively or additionally, weather seal calking may be applied to the joint of the window panel with the window frame members 234 and 236

The reinforced window panel wall 224 defines a rectangular window trim recess 246 within which one or more exterior window trim members 248 is seated. The window trim members are fastened in place by nails or screws and panel adhesive and are applied with joint seal cement to cement the exterior trim members in place and to seal any joints that might otherwise permit leakage of air into or out of the building. The fasteners provide for temporary fastening of the window trim members until the joint seal cement has become cured. The window trim members define internal window frame recesses 250 that accommodate the thickness of the mounting flanges 238 and the heads of the fasteners 240.

As mentioned above, it is a feature of the present invention to provide pre-manufactured reinforced wall and roof panels that are transported to a building site and used for rapid, low cost construction of buildings. It is also a feature of this invention to provide pre-manufactured reinforced wall and roof panels that include exterior weather resistant materials that are made integral with the panels by a molding process so that installation of the various wall, door, window and roof panels will result in a building structure that needs no exterior preparation in order to constitute a weather resistant building. As is evident from FIGS. 16-19, reinforced roof panels 252, which are also shown at 46 in FIGS. 1 and 3, are constructed with a roof panel body 254 having a weather resistant roof panel member 256 which is made integral therewith during the molding process for the roof panel. Each of the roof panel bodies 254 is of rectangular tongue and groove configuration defining tongue or rib members 257 on one side and at the top or bottom of the panel and grooves 258 on the opposite side and at the top or bottom. This tongue and groove design permits adjacent roof panels to be assembled in interlocking relation and to provide structural integrity to one another when assembled to form the roof structure of a building. The roof panels may be provided with lattice members 260 to permit the support of one or more interior ceiling panels that provide for additional insulation and decorative appearance of the internal surface of a building. To minimize the potential for sagging of the roof panels and to enhance the spanning capacity of the roofing panels, a layer of wire mesh or expanded metal 262 is embedded within the body 254 of the roof panels during the molding process. Other reinforcing members such as C or I shaped metal strips may also be embedded within the panel body during the molding process to retard the potential for roof panel sagging.

The weather resistant roof panel member 256 is shown in FIGS. 16-19 as a sheet of corrugated metal, but it is to be borne in mind that the weather resistant panel may conveniently take the form of standing rib metal roofing panels or roofing panels that are composed of non-metal materials such as fiberglass or polymer roofing materials. The weather resistant roof panel member 256 is placed within a mold, along with the wire mesh or expanded metal 262 so that the polyurethane and Portland cement mixture will achieve intimate contact and bonding with the roof panel member. The weather resistant roof panel member 256 is positioned relative to the panel body 254 so as to provide lateral overhang 264 on one side and bottom overhang 266. When installed, the lateral overhang will extend over the weather resistant roof panel member 256 of the adjacent roof panel and the bottom overhang will either extend over an adjacent lower roof panel of the weather resistant roof panel member 256 of the lower adjacent roof panel as shown in FIG. 20. If it is the bottom roof panel of a roof structure, the bottom overhang 266 will extend downwardly beyond the lower edge of the lowermost roof panel body so as to form a drip edge preventing rainwater from coming into contact with the lower edge of the roof panel body 254. As shown in FIG. 18, a roof panel structure may be provided with a top overhang 268 in addition to the bottom overhang 266 to ensure a desired length of roof material overlap for weather resistance. This can be important when the roof structure is oriented at low pitch. The pre-manufactured roof panels can be easily and simply installed in assembly with a building structure to quickly yield a weather resistant roof system. To assist in retention of adjacent roof panels in assembly and to orient adjacent roof panels for joint or overlap sealing, suitable fasteners, such as roofing nails 270 with sealing heads or roofing screws can be used as shown in FIG. 20.

Panel Pre-Manufacturing Method

An important aspect of the present invention is the method or process by which the pre-manufactured wall and roof panels are manufactured. As indicated by the simplified partial cross-sectional illustration of FIG. 21, a mold and mold press assembly is shown generally at 272. The mold 274 is provided with mold walls 276 and 278, one or both of which may be moveable to permit ease of extraction of a finished building panel from the mold. Mold wall 276 is a top mold wall while mold wall 278 is a bottom mold wall. Mold walls 276 and 278 are of substantially planar configuration and thus will provide for molding substantially planar interior and exterior wall surfaces of wall and roof panels. Mold edge members 279 are secured in position relative to the top and bottom mold walls and are configured to mold the top, bottom and side edges of the premanufactured building panels. After the mold walls have been separated from the hardened and dimensionally stable building panels resulting from the molding process the mold edge members 279 are separated from the edges of the panels. With the mold edge members in place on the bottom mold wall and with the top mold wall member moved downwardly and engaging the mold edge members, the polyurethane and Portland cement mixture can be injected into the mold cavity. Alternatively, with the top mold wall member raised above the mold edge members or moved away from the edge members of the mold, exposing the mold cavity, the polyurethane and Portland cement mixture can be poured into the open topped mold. A layer of kraft paper or a decorative wall surface material may then be placed onto the upper surface of the exposed molding medium as described above. Then the upper mold wall is moved downwardly into molding engagement with the mold edge members 279 to secure the mold and molding medium and to provide compression to prevent or control the expansion of the molding medium during preliminary curing. The kraft paper or decorative wall surface material ensures ease of separation of the top mold wall member from the mold and provides the building panel with a desired surface treatment or a desired surface configuration. A means is shown schematically at 280 in FIG. 21 for introducing a molding mixture or composition 282 into a mold cavity 284 that is defined between the mold walls 276 and 278. The means 280 may conveniently take the form of an injector or a system for pouring the molding mixture or composition 282 into the mold cavity.

The molding method or process is initiated by fixing the structural members, such as wall studs, wall frame members, door or window frame members, wire mesh or expanded metal reinforcing panels, roof anchor members and the like within the mold cavity 284. In this regard, it is to be understood that different molds or mold alterations will be utilized for molding the various wall, door, window and roof panels due to the need for fixing the reinforcing components, door frames, window frames an the like within the respective molds. A mold is then filled with a molding mixture or composition composed of two part polyurethane and Portland cement and the filled mold is subjected to further treatment, such as vibration, to ensure intimate contact of the molding mixture or composition with the reinforcing components of the panel structure and with the internal wall surfaces of the mold walls 276 and 278.

Either before or after the mold cavity 284 is filled with the molding mixture or composition, the mold is placed within a mold press shown generally at 286 having relatively moveable press wall members 288 and 289 that are oriented substantially horizontally as shown in FIG. 21. If desired, the press wall member 289 may be a fixed wall defining a mold support and the press wall member 288 may be a moveable wall which is employed to engage and apply sufficient force to the mold wall 276 to prevent transverse movement of one or both of the mold walls 276 and 278 by any internal force that may be developed within the mold cavity, such as by expansion of the molding mixture or composition 282, by hydrostatic pressure of the molding medium or by the injection pressure of the molding medium. By restraining the mold walls 276 and 278 as the molding medium is becoming cured, the finished dimensions of the resulting pre-manufactured panel will be accurately maintained and thus the panels may be easily assembled to form a building structure.

To impart mechanical pressure or force to the mold walls or to resist movement of the mold walls a number of force applying systems may be employed. As shown in FIG. 21 the mold press 272 may be of the hydraulic, electric screw or pneumatic type having a hydraulic, screw shaft or pneumatic cylinder 290 having a linearly moveable shaft 292 that is connected to the press wall member 288 via a connector 294. An internal piston of the cylinder 290 drives the shaft 292 in response to hydraulic or pneumatic pressure being introduced via supply and return lines 295 and 296 of a pressure supply 298. A press actuator control 300 may be selectively actuated for actuating the press to its force applying or force resisting condition. In the alternative, the mold press 272 may be actuated in any other suitable manner to resist molding medium expansion of the mold. For example, the mold press may have mold force resisting springs or may simply be mechanically actuated to a molding condition, such as by means of toggle linkages to stabilize the mold walls and prevent the molded panels from being mis-shapened by expansion of the molding medium during the molding process.

After the molding mixture or composition 282 has become sufficiently cured so that it has become hardened and its physical dimensions have become stabilized, though the pre-manufactured panel has not become completely cured, the mold press is retracted sufficiently to permit the mold to be removed. If desired, the mold, with the partially cured wall or roof panel inside, may be transported to a curing site for further curing. Alternatively, if the wall or roof panel has become sufficiently cured for removal from the mold, the mold is opened and the wall or roof panel is extracted. The partially cured, dimensionally stabilized wall or roof panel will then be moved to a site for further curing and the mold is then prepared for molding of another like wall or roof panel. Pre-manufacturing of numerous substantially identical wall and roof panels are pre-manufactured in this manner at a panel manufacturing site. Subsequently, the wall and roof panels are transported to a construction site having one or more foundations and are simply and efficiently installed to form building structures. These pre-manufactured wall and roof panels are especially useful when temporary housing is needed to accommodate conditions caused by a natural disaster or to accommodate the urgent human needs of a locality.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for forming a building structure, comprising:

placing a mold for a reinforced building panel on a generally horizontally oriented bottom press wall member of a press mechanism having relatively moveable generally horizontally oriented top and bottom press wall members, said mold having top and bottom generally horizontally oriented mold walls defining a rectangular mold cavity and being configured to mold interior and exterior surfaces of said reinforced building panel, said mold having mold edge members configured for molding top bottom and side edges of said reinforced building panel, said top generally horizontally oriented mold wall being removable from said mold;

with said top generally horizontally oriented mold wall removed from said mold locating panel reinforcing members and external weather resistant members within said mold cavity;

introducing a two-part polyurethane and Portland cement molding medium into said mold cavity in a substantially liquid state, the molding medium establishing intimate contact with said mold walls said panel reinforcing members and said external weather resistant members;

closing said mold by assembling said top generally horizontally oriented mold wall to said mold;

moving a said top and bottom press wall members toward one another and establishing compressive engagement with said top and bottom mold walls and securing said mold walls against movement during curing of the molding medium to define a hardened and dimensionally stable building panel structure for use as a wall panel or roof panel of a building;

after desired hardening of said molding medium causing separating movement of said at least one of said top and bottom press wall members and releasing said compressive engagement of said mold walls;

opening the mold by removing said top mold wall member from said mold and removing the hardened, dimensionally stable building panel from the mold cavity;

fixing a panel mounting member to outside edge portions of a building foundation at a construction site; and assembling a plurality of said reinforced building panels in side by side relation and with bottom portions thereof located within said panel mounting member and forming walls of a building structure having external weather resistant surfaces defined by said external weather resistant members.

2. The method of claim 1, wherein said panel reinforcing members are wall stud members and at least one structural mesh panel, said method comprising:

locating a plurality of wall stud members and at least one structural mesh panel within said mold; and upon said introducing a two-part polyurethane and Portland cement molding medium into said mold cavity, causing intimate contact of said molding medium with said wall stud members and said at least one structural mesh panel.

3. The method of claim 1, wherein said top and bottom mold walls are configured to defines internal and external wall surfaces of said reinforced building panels and said mold edge members are configured to define side, top and bottom edges of said reinforced building panels and said panel reinforcing members are metal wall stud members and at least one metal structural mesh panel, said at least one metal structural mesh panel being positioned in slightly spaced and parallel relation with at least one of said internal and external mold walls, said method comprising:

locating a plurality of metal wall stud members and at least one metal structural mesh panel within said mold; and upon said introducing a two-part polyurethane and Portland cement molding medium into said mold cavity, causing intimate contact of said molding medium with said metal wall stud members said top and bottom mold walls and said at least one structural mesh panel.

4. The method of claim 1, wherein said generally horizontally oriented top and bottom mold walls are configured to define internal and external surface configurations of said building panel walls and said mold edge members are configured to define configurations of side, top and bottom reinforced building panel edges and said panel reinforcing members are metal wall stud members of substantially C-shaped cross-sectional configuration defined by substantially parallel stud flanges each being integral with respective sides of a central stud web having a plurality of web apertures defined therein, said panel reinforcing members also being at least one metal structural mesh panel, said at least one metal structural mesh panel being positioned in slightly spaced and parallel relation with at least one of said internal and external mold walls, said method comprising:

locating a plurality of metal wall stud members and at least one metal structural mesh panel within said mold cavity and being supported by said bottom mold wall with said parallel stud flanges substantially parallel with said top and bottom mold walls and with said central stud web being oriented in transverse relation with said top and bottom mold walls; and upon said introducing a two-part polyurethane and Portland cement molding medium into said mold cavity, causing intimate contact of said molding medium with said stud flanges and central stud web of said metal wall stud members and with said molding medium extending through said plurality of web apertures and said at least one structural mesh panel.

5. The method of claim 1, said reinforced building panels comprising reinforced wall panels having interior and exterior panel surfaces and side edges defining tongue and groove panel edge joint connectors and top and bottom edges, said method comprising:

providing a building foundation;

mounting a bottom wall panel mounting member to said building foundation, said bottom wall panel mounting member having a horizontally oriented web and an upstanding flange;

positioning reinforced building panels as wall panels with interior and external wall surfaces thereof oriented substantially vertically and with said bottom edges of said reinforced wall panels positioned above said horizontally oriented web and with said interior and exterior panel surfaces oriented in substantially parallel relation with said upstanding flange of said bottom wall panel mounting member and with said tongue and groove panel edge joint connectors of said reinforced wall panels in engagement and forming the walls of a building structure; and fixing said bottom edges of said reinforced wall panels to said bottom wall panel mounting member.

6. The method of claim 5, comprising:

prior to said fixing step, positioning a bottom wall mounting and panel alignment channel on said wall panel mounting member, said wall mounting channel member being of C-shaped cross-sectional configuration having a central web and spaced channel flanges facing upwardly and defining a panel mounting channel receiving said bottom edges of said reinforced wall panels therein;

said fixing step extending fastener members through at least one of said spaced channel flanges and fixing said bottom edges of said reinforced wall panels both to said bottom wall mounting and panel alignment channel and said wall panel mounting member; and positioning a wall panel alignment cap in assembly with said top edges of said reinforced wall panels, said wall panel alignment cap being a channel member of C-shaped cross-section and having a central web and spaced substantially parallel depending channel flanges and extending fasteners through at least one of said depending channel flanges and securing said wall panel alignment cap to said top edges of said reinforced wall panels.

7. The method of claim 5, wherein said reinforced building panels also comprise reinforced roof panels having side edges defining tongue and groove panel joint connectors and having top and bottom edges, said reinforced roof panels having external weather resistant roofing material integral therewith and having at least a bottom portion and one side portion extending beyond said reinforced roof panel, said method comprising:

anchoring a roof framework to said reinforced wall panels; and fixing reinforced roof panels to said roof framework in side by side and end to end relation with said exterior roofing material of said reinforced roof panels overlapping at least one side and at least a top edge of adjacent reinforced roof panels and defining a drip edge extending beyond the lower edge of the lowermost reinforced roof panel.

8. The method of claim 5 comprising:

prior to said introducing said two-part polyurethane and Portland cement molding medium into said mold, positioning at least one roof anchor at least partially within said mold and with a portion of said at least one roof anchor engaging within an aperture of said wall stud and with a portion of said at least one roof anchor projecting from said mold;

after positioning of said reinforced wall panels assembling a roof framework to said wall panels with said at least one roof anchor projecting through a portion of said roof framework; and anchoring a roof framework to said reinforced wall panels with said at least one roof anchor; and fixing reinforced roof panels to said roof framework with said exterior roofing material of said reinforced roof panels overlapping at least one side and at least the top edge of adjacent reinforced roof panels and defining a drip edge extending beyond the lower edge of the lowermost reinforced roof panel.

9. The method of claim 7, wherein said reinforced building panels comprise reinforced wall panels composed of two-part molded polyurethane and Portland cement molding medium and having panel reinforcing members embedded therein, said reinforced wall panels having roof anchor members being at least partially embedded therein and being mechanically interconnected with said panel reinforcing members and projecting upwardly from said reinforced wall panels, said method comprising:

extending said roof anchor members through said roof framework by lowering roof framework onto said reinforced wall panels; and attaching retainer elements to said roof anchor members and securing said roof framework to said reinforced wall panels.

10. The method of claim 1, comprising:

after introducing said two-part polyurethane and Portland cement molding medium into said mold, locating said mold between said horizontally oriented and relatively moveable top and bottom press wall members and with said mold being supported by said bottom press wall member having relatively moveable press walls being moveable to a mold confining position and a mold release position;

confining said mold within said press with said relatively moveable press walls and preventing movement of said mold walls by any molding medium pressure caused by expansion of said molding medium during hardening thereof;

after hardening of said molding medium moving said relatively moveable press walls to said mold release positions and removing said mold from said press; and opening said mold and extracting said reinforced building panel therefrom.

11. The method of claim 1, wherein said reinforced building panel is a reinforced roof panel and said panel reinforcing members are metal mesh members and sheets of metal roofing material are integrally molded with said reinforced roof panel and have internal and external sheet surfaces; said method comprising:

locating said metal mesh members within said mold;

positioning at least one sheet of metal roofing material within said mold with said internal sheet surface facing within said mold and with said external sheet surface being supported by said bottom mold wall; and introducing said two-part polyurethane and Portland cement molding medium within said mold in intimate contact with said metal mesh members and in intimate contact with said internal sheet surface of said sheet of metal roofing material;

positioning the filled mold within a press having substantially horizontally oriented top and bottom press plate members and causing relative movement of said top and bottom press plate members toward one another and applying compression to said filled mold and restraining any molding medium expansion during curing of said molding medium to a hardened solid state;

after desired hardening of said molding medium causing relative separating movement of said top and bottom press plate members to positions releasing compression of said mold:

removing said mold from said press; and opening said mold and extracting said reinforced roof panel from said mold.

12. The method of claim 1, wherein said reinforced building panel is a reinforced door panel defining a door opening and said panel reinforcing members are metal wall stud members, metal mesh members and metal door frame members, said method comprising:

with said top generally horizontally oriented wall of said mold removed from said mold locating said metal wall stud members, mesh members and metal door frame members within said mold;

introducing said two-part polyurethane and Portland cement molding medium within said mold in intimate contact with said metal wall stud members, metal mesh members and metal door frame members and filling said mold;

securing said top generally horizontally oriented wall of said mold in assembly with said mold and closing said mold;

positioning the filled and closed mold within a press having relatively moveable generally horizontally oriented top and bottom press walls and moving said top and bottom press walls to compression positions engaging said filled and closed mold and restraining mold wall movement by said molding medium during curing expansion within said mold during curing of said molding medium from a substantially liquid state to a solid state;

removing said mold from between said top and bottom press walls of said press; and opening said mold by removing said top mold wall from said mold and extracting said reinforced door panel from said mold.

13. The method of claim 1, comprising:

after removing said reinforced door panel from said mold preparing interior and exterior surface finishes of said reinforced door panel.

14. The method of claim 1, wherein said reinforced building panel is a reinforced window panel defining a window opening and said panel reinforcing members are metal wall stud members, metal mesh members and metal window frame members, said method comprising:

with said top generally horizontally oriented mold wall removed from said mold locating said metal wall stud members, metal mesh members and metal window frame members and exterior weather resistant members within said mold cavity;

introducing said two-part polyurethane and Portland cement molding medium within said mold cavity and in intimate contact with said wall stud members metal mesh members and metal window frame members and in intimate contact with said exterior weather resistant material and filling said mold;

closing the filled mold by assembling said top mold wall to said mold;

moving the filled and closed mold within a press having relatively moveable top and bottom press walls and establishing force transmitting engagement of said top and bottom mold walls with said top and bottom press walls and restraining expansion of said mold by any curing expansion said molding medium during curing of said molding medium from a substantially liquid state to a solid state;

removing said mold from said press; and opening said mold by removing said top mold wall from said mold and extracting said reinforced window panel from said mold.

15. A method for forming a building structure, comprising:

locating a mold for a reinforced building panel at a mold filling site, said mold having substantially horizontally oriented top and bottom mold walls configured for molding interior and exterior surfaces of a reinforced building panel and having mold top bottom and side edge members configured for molding top bottom and side edges of the reinforced building panel and defining a generally rectangular mold cavity, said top mold wall being removable from said mold for opening said mold;

with said top generally horizontally oriented mold wall removed from said mold locating panel reinforcing members and external weather resistant members within said mold cavity;

introducing a two-part polyurethane and Portland cement molding medium into said mold cavity in a substantially liquid state, the molding medium establishing intimate contact with said top and bottom mold walls said panel reinforcing members and said external weather resistant members;

closing said mold by assembling said top generally horizontally oriented mold wall to said mold;

moving said filled and closed mold laterally into an open mold press having relatively moveable top and bottom generally horizontally oriented press wall members;

closing said mold press by moving said relatively moveable top and bottom generally horizontally oriented press wall members toward one another and into compressive engagement with said top and bottom mold walls and applying sufficient compression to restrain said top and bottom mold walls against being moved or deformed by the pressure of any expansion of said molding medium during hardening thereof;

after curing of said molding medium to a hardened state opening said mold press by causing relative movement of said top and bottom mold wall members away from one another;

moving said mold laterally from between said top and bottom press wall members;

opening said mold by removing said top mold wall from said mold;

removing the hardened reinforced building panel from said mold cavity;

securing a U-shaped panel mounting channel to outer edge portions of a building foundation;

positioning a plurality of said reinforced building panels in side by side relation with bottom portions located within said panel mounting channel;

positioning a U-shaped panel alignment channel on upper end portions of said plurality of said reinforced building panels;

mounting a roof framework on said U-shaped panel alignment channel; and mounting a plurality of reinforced roof panels on said roof framework.

16. The method for forming a building structure of claim 15, comprising:

prior to step of introducing a two-part polyurethane and Portland cement molding medium into said mold cavity, selectively locating within said mold cavity metal mesh material wall stud members, window frame members door frame members and exterior weather resistant panel members for molding of reinforced building panel members in the form of wall panels, window panels, door panels or roof panels.

17. The method for forming a building structure of claim 15 wherein said panel reinforcing members are wall stud members and at least one structural mesh panel, said method comprising:

locating a plurality of wall stud members and at least one structural mesh panel within said mold; and upon said introducing a two-part polyurethane and Portland cement molding medium into said mold cavity, causing intimate contact of said molding medium with said wall stud members and said at least one structural mesh panel.

18. The method of claim 15, wherein said top and bottom mold walls are configured to define internal and external panel wall surfaces of said reinforced building panels and said mold edge members are configured to define side, top and bottom edges of said reinforced building panels and said panel reinforcing members are metal wall stud members and at least one metal structural mesh panel, said at least one metal structural mesh panel being positioned in slightly spaced and parallel relation with at least one of said internal and external mold walls, said method comprising:

locating a plurality of metal wall stud members and at least one metal structural mesh panel within said mold cavity; and upon said introducing a two-part polyurethane and Portland cement molding medium into said mold cavity, causing intimate contact of said molding medium with said metal wall stud members said top and bottom mold walls and said at least one structural mesh panel.

19. The method of claim 15, wherein said generally horizontally oriented top and bottom mold walls are configured to define internal and external surface configurations of said building panel walls and said mold edge members are configured to define configurations of side, top and bottom reinforced building panel edges and said panel reinforcing members are metal wall stud members of substantially C-shaped cross-sectional configuration defined by substantially parallel stud flanges each being integral with respective sides of a central stud web having a plurality of web apertures defined therein, said panel reinforcing members also being at least one metal structural mesh panel, said at least one metal structural mesh panel being positioned in slightly spaced and parallel relation with at least one of said internal and external mold walls, said method comprising:

locating a plurality of metal wall stud members and at least one metal structural mesh panel within said mold cavity and being supported by said bottom mold wall with said parallel stud flanges substantially parallel with said top and bottom mold walls and with said central stud web being oriented in transverse relation with said top and bottom mold walls; and upon said introducing a two-part polyurethane and Portland cement molding medium into said mold cavity, causing intimate contact of said molding medium with said stud flanges and central stud web of said metal wall stud members and with said molding medium extending through said plurality of web apertures and said at least one structural mesh panel.

20. The method of claim 15, comprising:

prior to said fixing step, positioning a bottom wall mounting and panel alignment channel on said wall panel mounting member, said wall mounting channel member being of C-shaped cross-sectional configuration having a central web and spaced channel flanges facing upwardly and defining a panel mounting channel receiving said bottom edges of said reinforced wall panels therein;

said fixing step extending fastener members through at least one of said spaced channel flanges and fixing said bottom edges of said reinforced wall panels both to said bottom wall mounting and panel alignment channel and said wall panel mounting member;

positioning a wall panel alignment cap in assembly with said top edges of said reinforced wall panels, said wall panel alignment cap being a channel member of C-shaped cross-section and having a central web and spaced substantially parallel depending channel flanges and extending fasteners through at least one of said depending channel flanges and securing said wall panel alignment cap to said top edges of said reinforced wall panels, said reinforced building panels also comprise reinforced roof panels having side edges defining tongue and groove panel joint connectors and having top and bottom edges, said reinforced roof panels having external weather resistant roofing material integral therewith and having at least a bottom portion and one side portion extending beyond said reinforced roof panel, said method comprising:

anchoring a roof framework to said reinforced wall panels; and fixing reinforced roof panels to said roof framework in side by side and end to end relation with said exterior roofing material of said reinforced roof panels overlapping at least one side and at least a top edge of adjacent reinforced roof panels and defining a drip edge extending beyond the lower edge of the lowermost reinforced roof panel.

* * * * *